US005911384A

United States Patent [19]

Peters

[11] Patent Number: 5,911,384

[45] Date of Patent: Jun. 15, 1999

[54] UNLOADING DEVICE FOR PAPER-WINDING MACHINE

[75] Inventor: Hans-Friedrich Peters, Düsseldorf, Germany

[73] Assignee: Jagenberg Papiertechnik GmbH, Neuss, Germany

[21] Appl. No.: 09/161,888

[22] Filed: Sep. 28, 1998

[30] Foreign Application Priority Data

Sep. 30, 1997 [DE] Germany ..... 197 43 070

[51] Int. Cl.[6] ..... B65H 18/08

[52] U.S. Cl. ..... 242/530.1; 242/530.4; 242/533.2; 242/533.3

[58] Field of Search ..... 242/530.1, 530.3, 242/530.4, 533.2, 533.3

[56] References Cited

U.S. PATENT DOCUMENTS

| | | | |
|---|---|---|---|
| 3,072,353 | 1/1963 | Moser | 242/525.5 |
| 3,406,925 | 10/1968 | Waterhouse | 242/533.2 |
| 3,765,616 | 10/1973 | Hutzenlaub et al. | 242/56.5 |
| 3,841,578 | 10/1974 | Dorfel | 242/66 |
| 3,918,654 | 11/1975 | Okubo et al. | 242/56 R |
| 3,990,648 | 11/1976 | Justus et al. | 242/66 |
| 4,135,674 | 1/1979 | Bartmann | 242/64 |
| 4,456,190 | 6/1984 | Karttunen et al. | 242/56 R |
| 4,516,735 | 5/1985 | Snygg | 242/56 R |
| 4,572,451 | 2/1986 | Ikeda et al. | 242/56 R |
| 4,635,867 | 1/1987 | Kytonen | 242/56 R |
| 4,669,646 | 6/1987 | Oinonen | 226/194 |
| 5,356,087 | 10/1994 | Smith et al. | 242/525 |
| 5,853,139 | 12/1998 | Hehner et al. | 242/530.1 |

FOREIGN PATENT DOCUMENTS

| | | | |
|---|---|---|---|
| 431275 | 6/1991 | European Pat. Off. | 242/530.1 |
| J8235 | 12/1955 | Germany | 242/533.3 |
| 1 229 361 | 3/1961 | Germany . | |
| 2928543 | 1/1981 | Germany | 242/533.3 |
| 32 07 461 | 9/1983 | Germany . | |
| 38 11 871 | 10/1989 | Germany . | |
| 360118562 | 6/1985 | Japan | 242/533.2 |
| 1242525 | 8/1971 | United Kingdom | 242/533.3 |

*Primary Examiner*—Donald P. Walsh
*Assistant Examiner*—Minh-Chau Pham
*Attorney, Agent, or Firm*—Herbert Dubno; Andrew Wilford

[57] ABSTRACT

A winding machine has a pair of support rollers defining an upwardly open cradle holding a plurality of rolls centered on a common roll axis, a slitter for cutting a wide web into a plurality of strips and feeding each of the strips to the rolls for winding up thereon, and a knockout element having a surface curved convexly toward and engageable with the rolls. This knockout element can be displaced toward the rolls to engage the surface against the rolls and push the rolls out of the cradle while axially separating the rolls.

6 Claims, 5 Drawing Sheets

UNLOADING DEVICE FOR PAPER-WINDING MACHINE

FIELD OF THE INVENTION

The present invention relates to a machine for winding strips of paper up into rolls. More particularly this invention concerns a device for unloading the finished rolls from such a machine.

BACKGROUND OF THE INVENTION

In a standard winding or rewinding machine a web, normally of paper or cardboard some 5 m or more wide, is longitudinally slit into a plurality of strips that are fed to adjacent coaxial cores on which they are simultaneously wound. As described in German patent 1,229,361 of Moser, German patent document 3,207,461, German patent document 3,811,871 of Dropczynski, and U.S. Pat. No. 5,222,679 also of Dropczynski, the rolls being wound are supported in an upwardly open cradle formed by a pair of driven support rollers. Once the rolls have the desired diameter the finished rolls are removed from the winding cradle and then typically marked or wrapped for transport to the end user.

The difficulty in this last operation is that the rolls are wound up immediately adjacent each other, as the incoming web is slit immediately upstream and it is impossible to significantly separate the strips from each other. Thus the rolls effectively abut one another and must be separated so that they can be marked, wrapped, and handled. This is a laborious operation as such rolls can be more than 1 m in length and diameter and can weigh several tons each. The machines provided for separating the rolls to expose their ends and, frequently, unstick them from one another are bulky and complex.

OBJECTS OF THE INVENTION

It is therefore an object of the present invention to provide an improved unloading device for a paper-winding machine.

Another object is the provision of such an improved unloading device for a paper-winding machine which overcomes the above-given disadvantages, that is which simply and surely separates the finished rolls and that is of relatively simple construction.

SUMMARY OF THE INVENTION

A winding machine has according to the invention a pair of support rollers defining an upwardly open cradle holding a plurality of rolls centered on a common roll axis, a slitter for cutting a wide web into a plurality of strips and feeding each of the strips to the rolls for winding up thereon, and a knockout element having a surface curved convexly toward and engageable with the rolls. This knockout element can be displaced toward the rolls to engage the surface against the rolls and push the rolls out of the cradle while axially separating the rolls.

Such an arrangement is extremely simple. As the arcuate surface is pressed against the row of coaxial rolls in the cradle, it first cants and separates the center two rolls, then as it engages the rolls offset from the center, it cants and separates them. Once it has engaged all the rolls it has in effect distributed them along the surface of the beam, which is longer than the original axial dimension they occupied, and they are pushed while thus spaced out of the cradle. The additional spacing thus formed between the rolls makes marking, handling, and wrapping them fairly simple.

The arcuate surface according to the invention has a center region lying between end regions and between 5 mm and 50 mm closer to the rolls than the end regions.

The element in accordance with the invention can be formed by an arcuate core shaft and a plurality of sleeve rollers rotatable on the core shaft. In this case each sleeve roller is between 500 mm and 1000 mm long. Alternately or the knockout element can be a rigid curved beam.

The knockout element according to the invention is provided to one horizontal side of the support rollers and on the other side is a stage pivotal between an upright position and a horizontal position so that when the rolls are pushed out of the cradle the run off on the stage in the horizontal position thereof.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
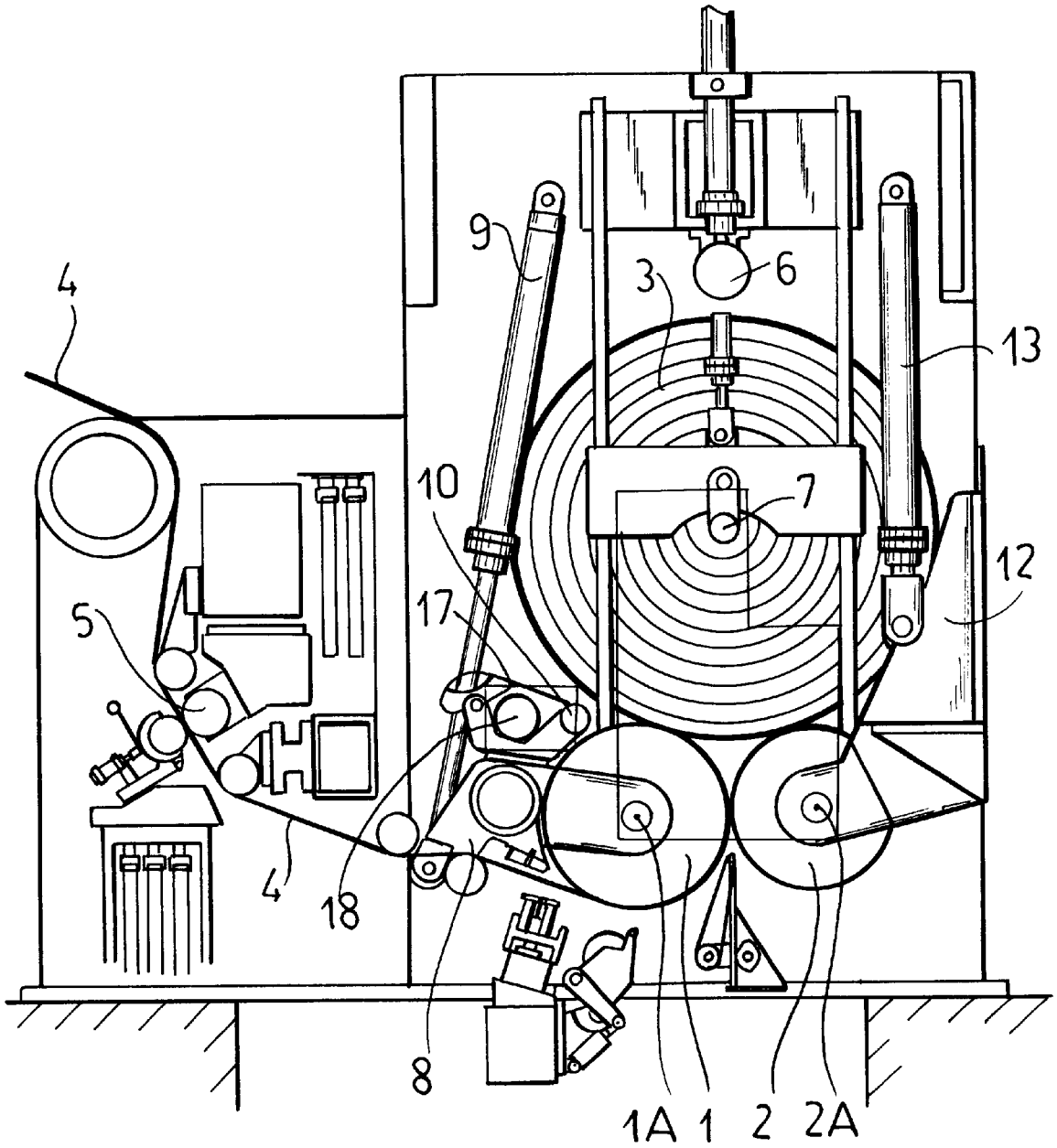
FIG. 1 is a partly diagrammatic side view of a paper-winding machine according to the invention.

As seen in FIG. 1 a standard winding machine as described in the above-cited patent documents has a pair of horizontal driven support rollers 1 and 2 rotatable about respective horizontal axes 1A and 2A level with each other to form an upwardly open cradle supporting a plurality of coaxial rolls 3. A web 4 is cut by a longitudinal splitter 5 into a plurality of parallel strips each fed to and wound up on a respective one of the rolls 3 which are formed on respective tubular cores carried at least to start with on centering heads 7. Hold-down rollers 6 above the rolls 3 press the rolls 3 down against the rollers 1 and 2 to ensure tight winding at least at the start of winding when the rolls 3 are not heavy.

A pair of arms 8 pivotal at the axis 1A by actuators 9 carry a knockout element 10 described in more detail below. In addition these arms 8 support an auxiliary knockout beam 17 and can hold a plurality of empty cores 18 onto which new rolls 3 can be wound. Thus these arms 8 operate both to unload the rolls 3 from the machine when they are wound to the desired diameter, and to put fresh empty cores 18 into the cradle formed by the rollers 1 and 2 to start a new cycle.

A run-out stage 12 is pivotal at the axis 2A by actuators 13 and can move from the illustrated vertical position in which it shields and holds in place the rolls 3 as they are formed to a horizontal position supporting them as they are pushed out of the cradle formed by the rollers 1 and 2.

Figure 2:
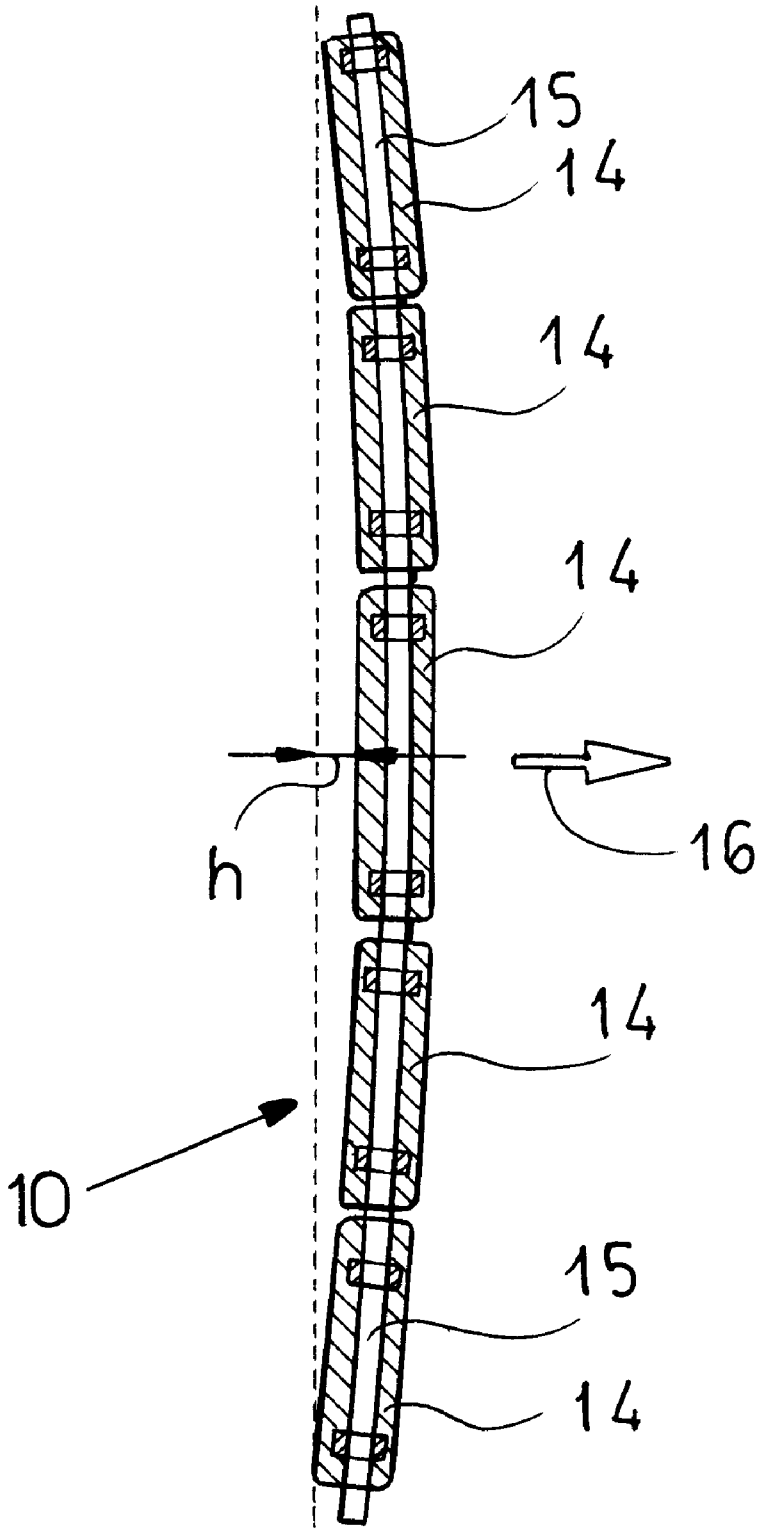
FIG. 2 is a schematic top view of the knockout roller in accordance with the invention.

The knockout element 10 as shown in FIG. 2 is formed by a curved core shaft 15 fixed in the arms 8 and carrying a plurality of tubular sleeve rollers 14 here all of the same diameter. The curvature of the core shaft 15 in a knockout direction 16 is such that the center roller 14 is ahead by a distance h of the end rollers 14. Here the sleeve rollers 14 are between 500 mm and 1000 mm long and have a diameter between 150 mm and 250 mm. The distance h is between 5 mm and 50 mm, 20 mm with a working width of the machine of 5 m. The ends of the rollers 14 are rounded or chamfered to prevent them from scoring or marring the rolls 3.

Figure 3:
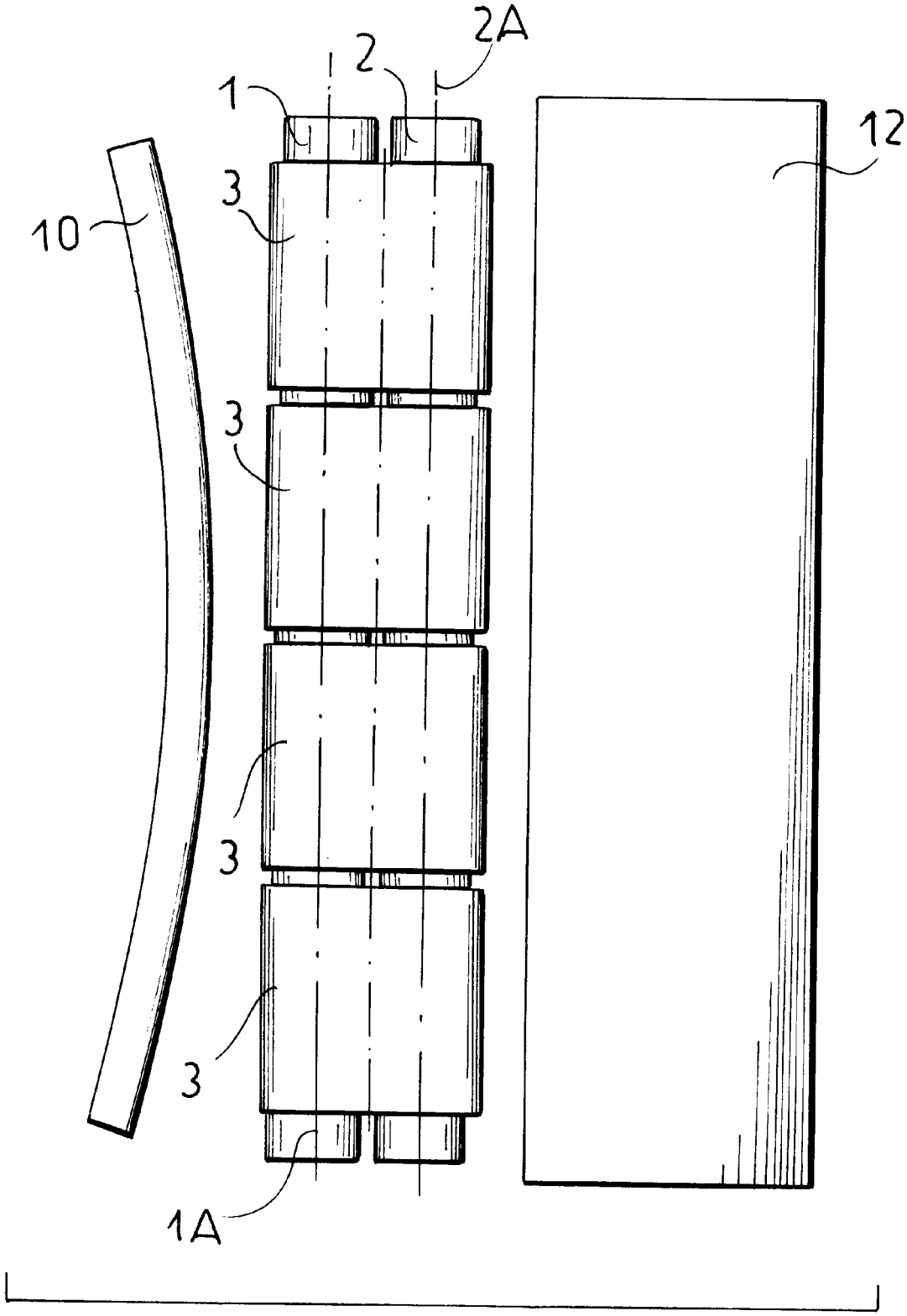
FIGS. 3 through 5 are schematic top views illustrating how the knockout device of the invention functions.
Figure 4:
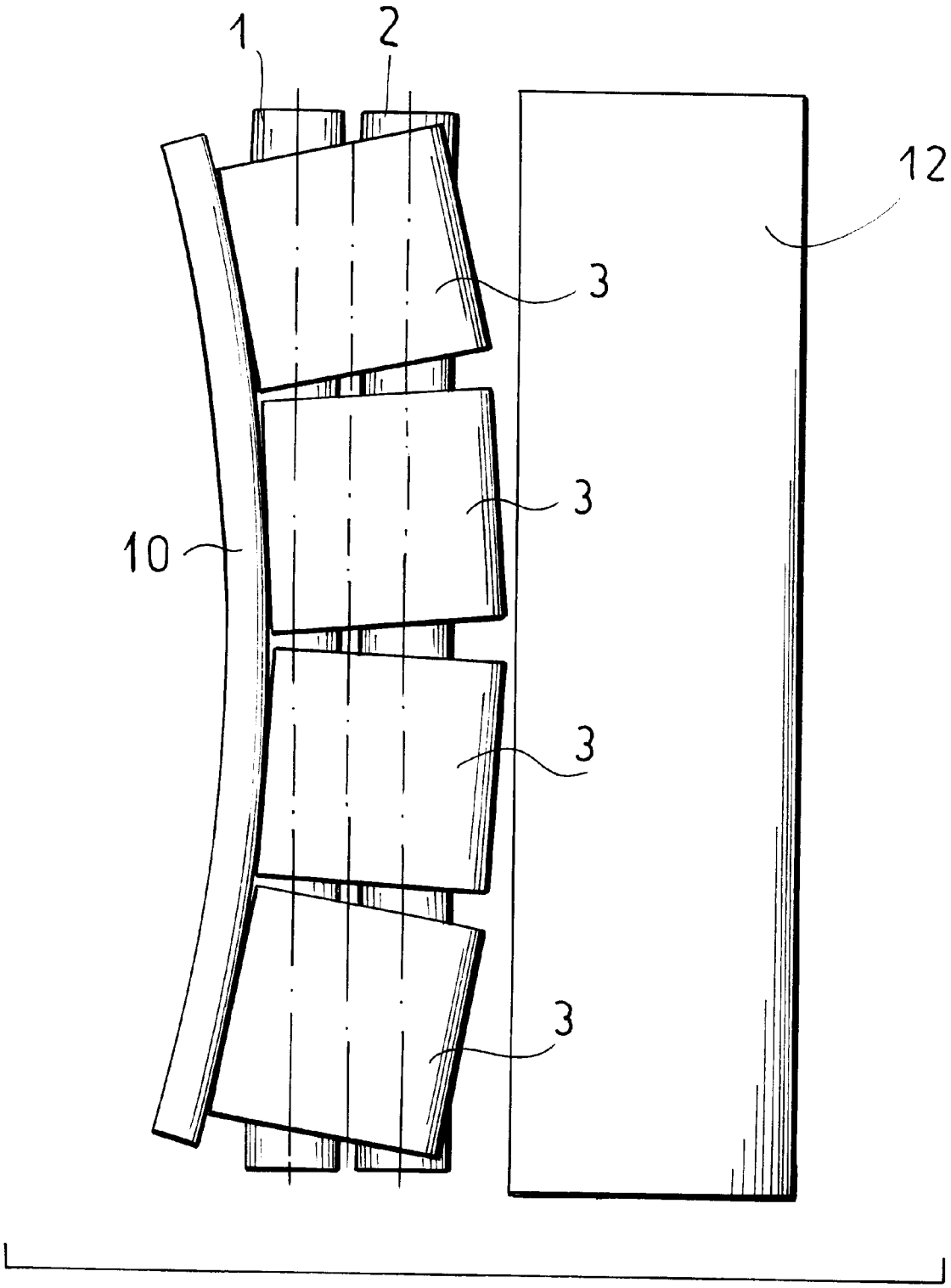
Figure 5:
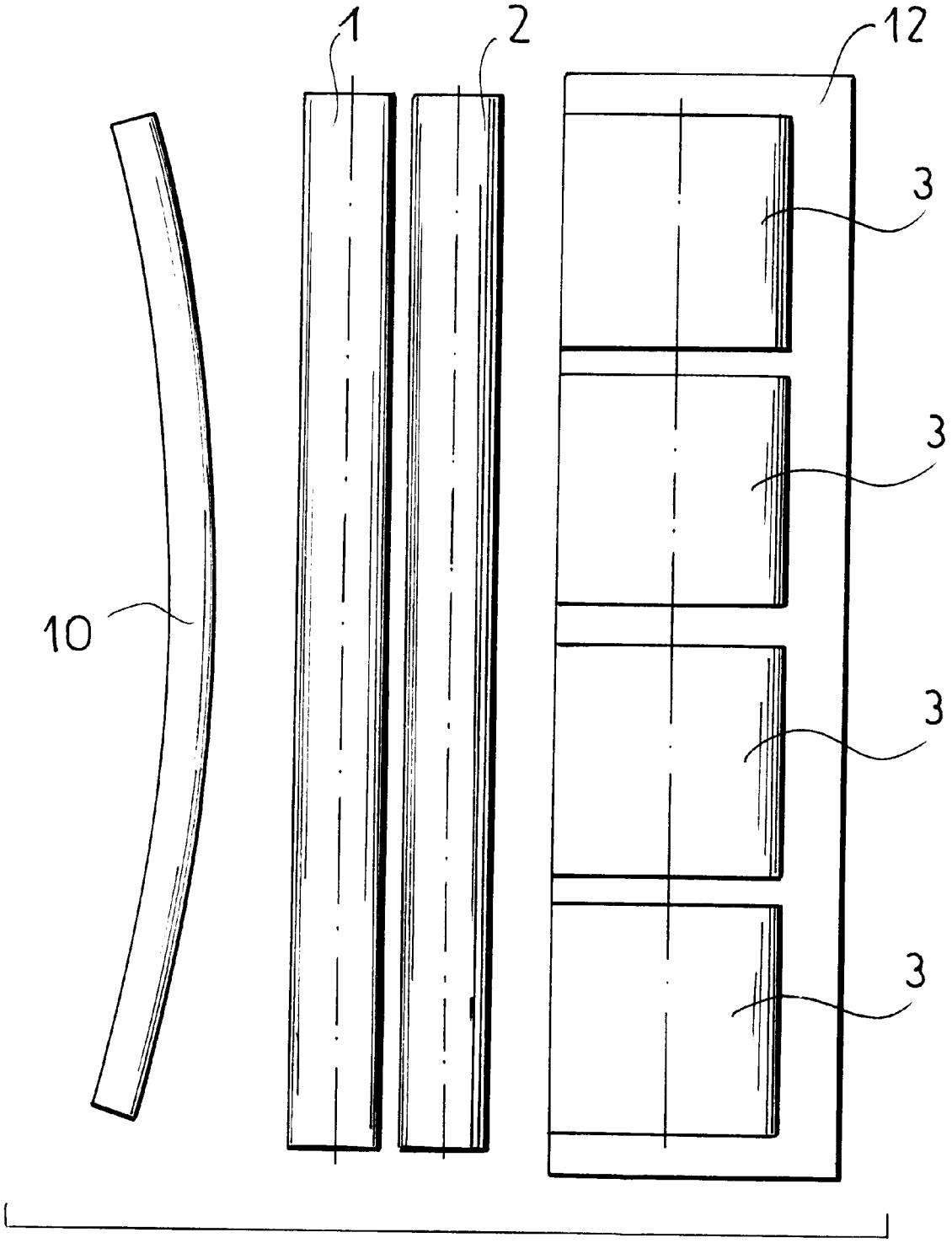

Thus as illustrated in FIGS. 3 through 5 as the element 10 is pressed against the rolls 3 it will first engage the center rolls 3, canting them slightly to each other and will eventually engage the outer rolls 3, canting them even more as shown in FIG. 4. Eventually, with the aid of the auxiliary beam 17, they will be pushed off onto the lowered run-out stage 12 where, as can be seen by a comparison of FIGS. 3 and 5, the axial spacing between adjacent rolls 3 is substantially increased.

Instead of like-diameter rollers 14 on an arcuate core shaft, it is possible to use like-diameter rollers on a stepped shaft, that is with the center rollers advanced ahead of the end rollers. What is important is that the surface of the rollers 14 is convexly arcuate toward the rolls 3.

In the illustrated embodiment the auxiliary knockout beam 17 which engages the rolls 3 after the element 10 has pushed them substantially out of the roller cradle is also arcuate like the element 10.

I claim:

1. A winding machine comprising:

a pair of support rollers defining an upwardly open cradle holding a plurality of rolls centered on a common roll axis;

means for cutting a wide web into a plurality of strips and feeding each of the strips to the rolls for winding up thereon;

a knockout element having a surface curved convexly toward and engageable with the rolls; and means for displacing the element toward the rolls to engage the surface against the rolls and push the rolls out of the cradle while axially separating the rolls.

2. The winding machine defined in claim 1 wherein the surface has a center region lying between end regions and between 5 mm and 50 mm closer to the rolls than the end regions.

3. The winding machine defined in claim 1 wherein the element is formed by an arcuate core shaft; and a plurality of sleeve rollers rotatable on the core shaft.

4. The winding machine defined in claim 3 wherein each sleeve roller is between 500 mm and 1000 mm long.

5. The winding machine defined in claim 1 wherein the knockout element is a rigid curved beam.

6. The winding machine defined in claim 1 wherein the knockout element is provided to one horizontal side of the support rollers, the machine further comprising a stage on the other horizontal side of the support rollers and pivotal between an upright position and a horizontal position, whereby when the rolls are pushed out of the cradle the run off on the stage in the horizontal position thereof.

* * * * *